US005310258A

United States Patent [19]

Godat et al.

[11] Patent Number: 5,310,258

[45] Date of Patent: May 10, 1994

[54] MACHINE FOR STIRRING PAINTS

[75] Inventors: Jean Godat, Olivet; Alain Krzywdzjak, Orleans, both of France

[73] Assignee: F.A.S. Fabrication d'Appareils Mecaniques Speciaux, St-Jean-le-Blanc, France

[21] Appl. No.: 1,332

[22] Filed: Jan. 7, 1993

[30] Foreign Application Priority Data

Jan. 7, 1992 [FR] France ..... 92 00068

[51] Int. Cl.[5] ..... B01F 7/06

[52] U.S. Cl. ..... 366/251; 366/605

[58] Field of Search ..... 366/208, 251, 209, 242, 366/244, 245, 247, 249, 279, 605

[56] References Cited

U.S. PATENT DOCUMENTS

| | | | |
|---|---|---|---|
| 2,757,910 | 8/1956 | O'Neill | 366/605 |
| 4,225,248 | 9/1980 | Para | 366/251 |
| 4,407,584 | 10/1983 | Boudin et al. . | |

FOREIGN PATENT DOCUMENTS

| | | |
|---|---|---|
| 0035422 | 2/1981 | European Pat. Off. . |
| 0298806 | 6/1988 | European Pat. Off. . |
| 2562874 | 4/1984 | France . |
| 2203059 | 10/1988 | United Kingdom . |

*Primary Examiner*—Robert W. Jenkins

*Attorney, Agent, or Firm*—Scully, Scott, Murphy & Presser

[57] ABSTRACT

The invention relates to a machine for stirring paints.

This machine is of the type comprising support racks (3) of cans of tints provided with an upper stirrer lid (5), and a mechanism for driving the stirrer lids on each of the racks, the stirrer lids (5) each being provided with a motion take-up pinion (27) for the stirrer shaft inside the cans. It is characterized in that said mechanism for driving the stirrer lids brings into play a set of endless screws (29) mounted one on each of the racks, these screws each coming to mesh with the driving pinions (27) of the stirrer lids of a same rack and being driven at an adequate speed of rotation, which is variable depending on the range of the cans of tints of the racks.

12 Claims, 5 Drawing Sheets

MACHINE FOR STIRRING PAINTS

The present invention relates to a stirring machine for paints, of the type comprising support racks of cans of tints provided with an upper stirrer lid, and a mechanism for driving the stirrer lids on each of the racks, the stirrer lids each being provided with a motion take-up pinion for the stirrer shaft inside the cans.

The invention relates in particular to an improvement of the transmission of motion to the stirrer lids.

On known stirring machines of this type, the driving of the stirrer lids is essentially effected by means of a transmission with chains, one on each rack meshing externally along its length with the drive pinions of the positioned lids. The chains for driving the racks are themselves driven by pinions from a main vertical shaft mounted laterally over the height of the machine and actuated by a lower speed-reducing unit.

This type of motion transmission does not lend itself easily to a change of configuration of the racks of the machine.

The invention aims to remedy these disadvantages and proposes a stirring machine for paints, of the type comprising support racks of cans of tints provided with an upper stirrer lid, and a mechanism for driving the stirrer lids on each of the racks, the stirrer lids each being provided with a motion take-up pinion for the stirrer shaft inside the cans, wherein the said mechanism for driving the stirrer lids brings into play a set of endless screws mounted one on each of the racks, these screws each coming to mesh with the pinions for driving the stirrer lids of a same rack and being driven at an adequate speed of rotation, which is variable depending on the range of the cans of tints of the racks.

The driving of the screws (which necessitates a weak rotational torque) is advantageously effected by means of a transmission by driving belts, preferably serrated, (in order to ensure a transmission of strict speed) and driven pulleys securely attached to the screws or else with chains and pinions at the ends of screws, on one of the sides of the machine.

A series of belts or chains permits the take-up of the motion from one rack to the next.

As a result of this arrangement it is possible to use in order to drive the machine a simple electric motor of asynchronous type without having need for a speed-reducing unit, the main reduction being produced by the endless screws. This reduction is sufficient to ensure a suitable speed of rotation of the stirrer shafts of the lids.

The motor can thus be arranged horizontally with its driving pulley (or a pinion) meshed directly with the driving belt(s) or chain(s). In these conditions, a low horizontal implantation of the motor does not obstruct the positioning of the cans on the bottom rack, which consequently remains totally available.

Naturally, this type of motion transmission is suitable for stirring machines receiving stirrer lids with their cans positioned in suspension on the racks, or even with clipping for positioning the cans placed on the racks.

Other features and advantages of the invention will become apparent hereafter by reading the description of one example of an embodiment and by reference to the accompanying drawings, in which.

Figure 1:
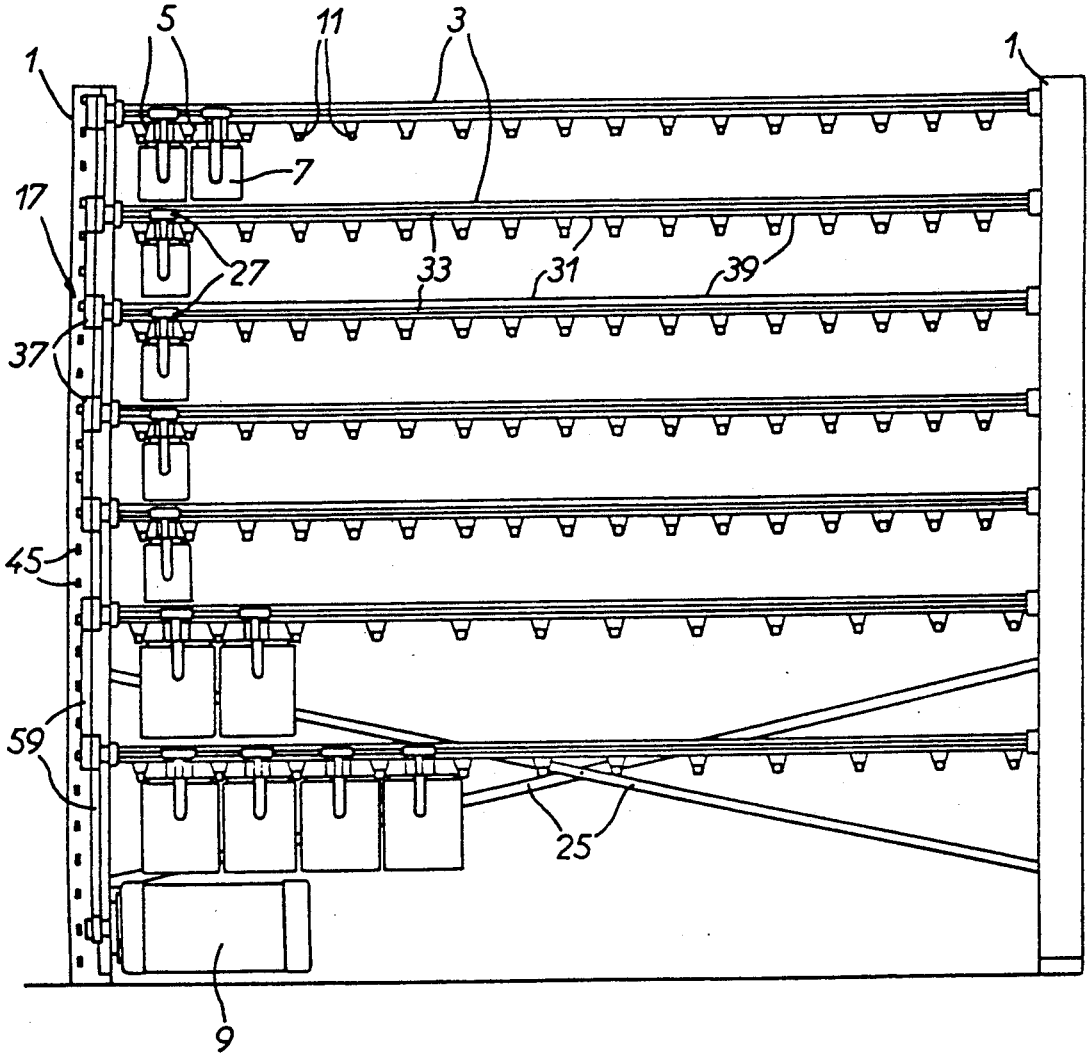
FIG. 1 is a diagrammatic view in elevation of a stirring machine for paints according to the invention.
Figure 2:
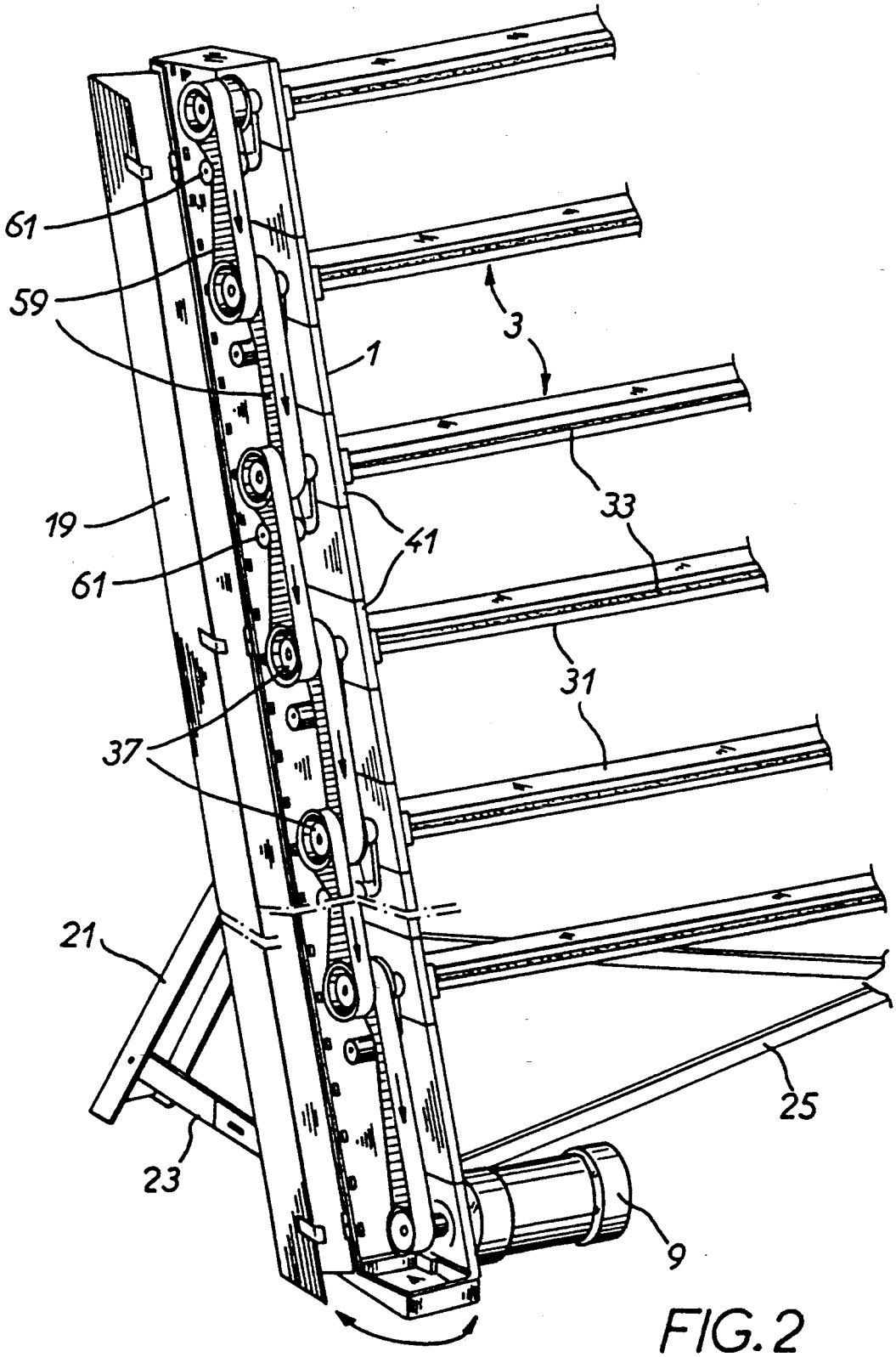
FIG. 2 is a view in perspective of this machine, but with a drive by lateral belts.

As shown in FIGS. 1 and 2, the stirring machine according to the invention is essentially constituted by two lateral uprights 1, to which are attached horizontally support racks 3 of the stirrer lids 5 of the cans of tint 7, and by a driving electric motor 9 at the lower level. The cans of tint 7 are secured to the lids, which are themselves suspended from the rack in conventional manner by transverse brackets 11.

The racks are hooked onto the uprights through the intermediary of hooks 13 at their ends, engaged in corresponding perforations 15 formed at regular intervals along the length of the uprights. They can consequently be arranged with variable spacing and height depending on the desired load configuration of the machine, and as a function of the sizes of the cans of tint.

One of the uprights houses part of the system 17 for driving the stirrer lids of the cans of tints on the racks. This drive system is protected by a longitudinal casing 19 (FIG. 4), mounted articulated laterally on the upright and over its height.

The machine is tilted slightly backwards, resting on two back legs 21 which may be folded back and the spread of which is limited by a caliper 23 blocked upon opening. A rigidifying cross 25 may be secured on the back support legs or preferably on the vertical uprights. This arrangement with hooking of the racks onto the uprights and support on the foldable back legs permits a rapid erection of the machine without tools. Naturally, the machine may again be constructed in a vertical version on a front and rear support foot. Nevertheless, the tilted version improves the stability of the machine and confers good access to the stirrer lids. Moreover, the residual paint (a few drops) from the stirrer lid nosepieces, after use, does not fall on the underlying racks but can be collected on the ground.

Figure 3:
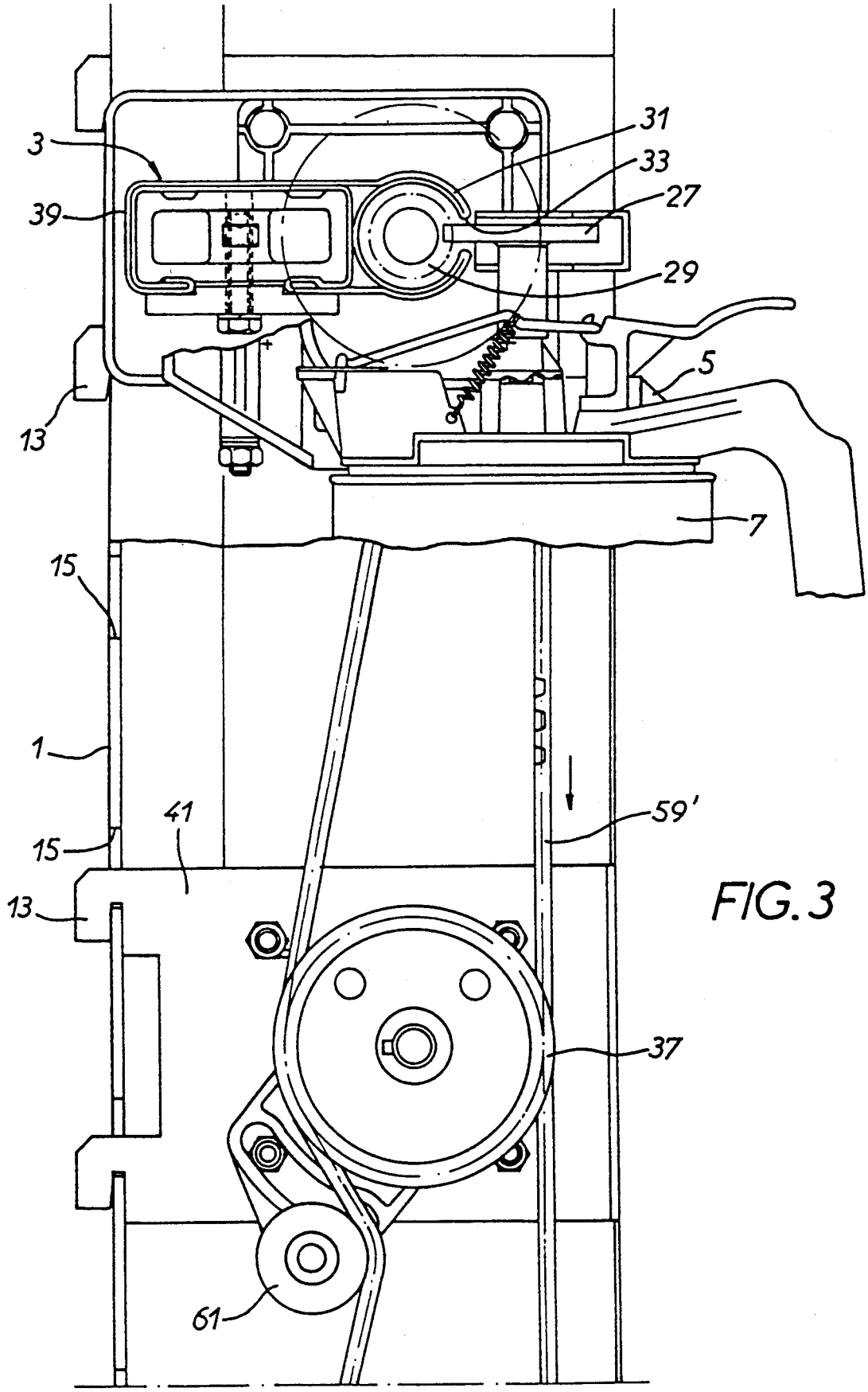
FIG. 3 is an enlarged side view with cutaway of the machine showing two successive racks.
Figures 4, 5, 6:
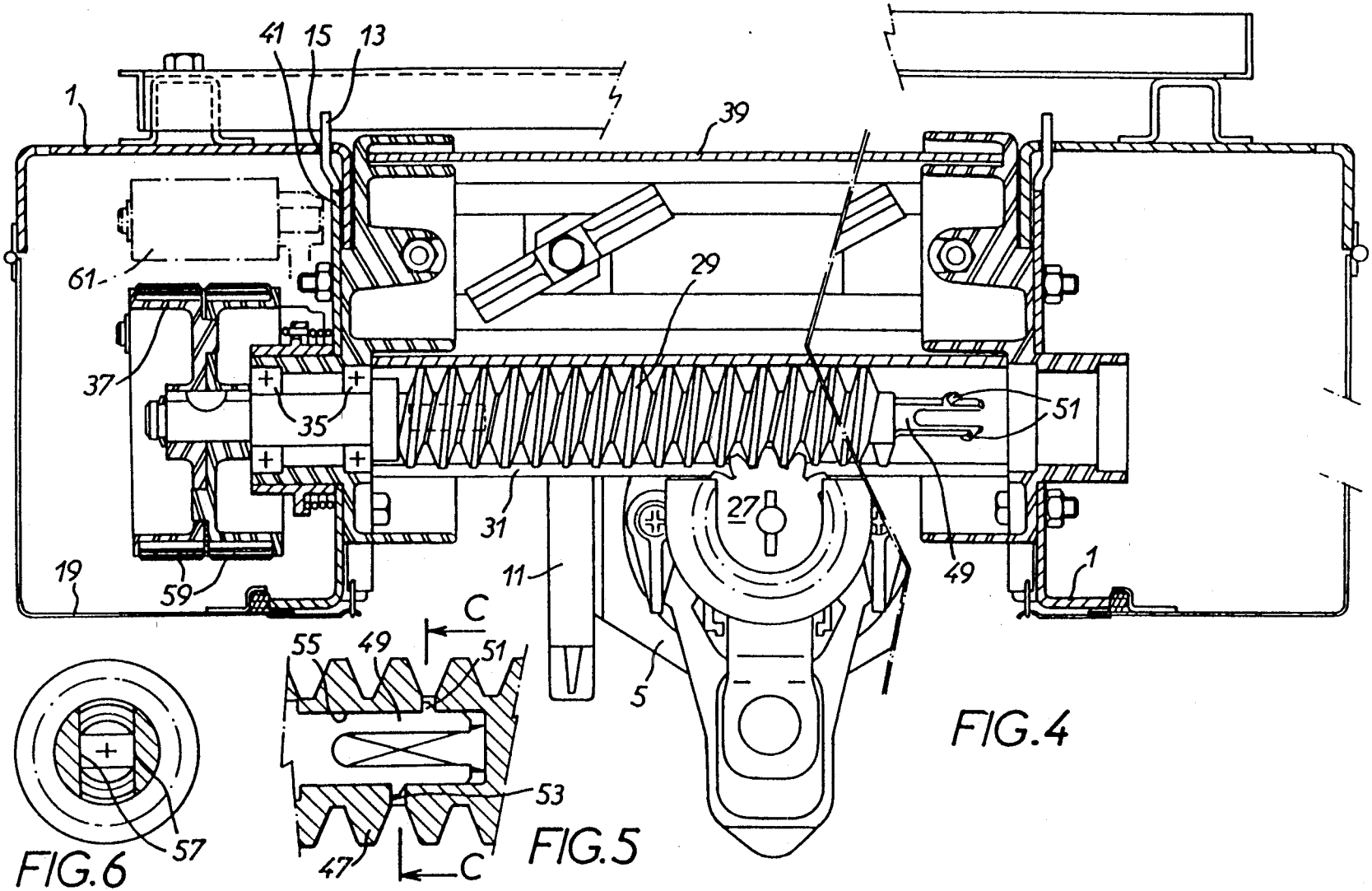
FIG. 4 is a horizontal cross-section of a rack showing in particular the driving of the stirrer lids by an endless screw.
FIG. 5 is a partial cross-section showing the assembly of members of an endless screw for driving.
FIG. 6 is a cross-section along the line C—C of FIG. 5.

As shown in FIGS. 3 and 4, the stirrer lids with their drive pinions 27 are driven by means of endless screws 29, implanted one on each of the racks. These screws are driven in rotation by means of the lateral transmission on upright driven by the lower motor 9. The screws are implanted inside a sleeve 31 provided with a longitudinal slot 33 at the front. This slot permits the teeth of the pinions of the lids, when they are fitted, to be placed in contact with the thread of the screw. The screws are mounted swivelling through end journals on the lateral uprights. These ball-bearing-type journals 35 support the drive pulleys 37 of the screws at their end, inside the upright. They are each, in addition, securely attached to a plate 41. These plates are connected to a support profile 39 of the brackets 11, and they are provided with two hooks 13 (mentioned above) f or hooking the rack onto the uprights, through perforations 15 in the uprights.

The endless screws may be constituted by short members 47 of injected plastic material, about 300 mm long.

These members are connected to one another with perfect coincidence of the threads so as to adapt to the desired screw length, usually from one to three meters, depending on the width of the machine. These screw members comprise a split male end 49 provided with two external helical parts 51 at the same pitch as the screw. These parts come, upon assembly of the members, to engage resiliently and with locking in a complementary recess 53 of a corresponding female part 55. FIG. 6 shows that the driving in rotation of the members is performed by the opposed flats 57 of the ends.

In the embodiment of FIG. 3, the driven drive pulleys 37 are of double serrated type. They receive two serrated belts, one receiving the motion from the lower rack, each of the belts being held in place by means of a stretcher roller 61 as shown in FIG. 3. The driving is effected in direct connection from the pulley of the motor, which motor is of asynchronous electric type. A speed reduction may be produced by the set of pulley diameters of the motor, for example depending on the supply frequency, which may vary from 50 to 60 Hz from country to country, and in such a manner that the suitable speed of rotation of the stirrer shafts of the lids is maintained.

Figure 7:
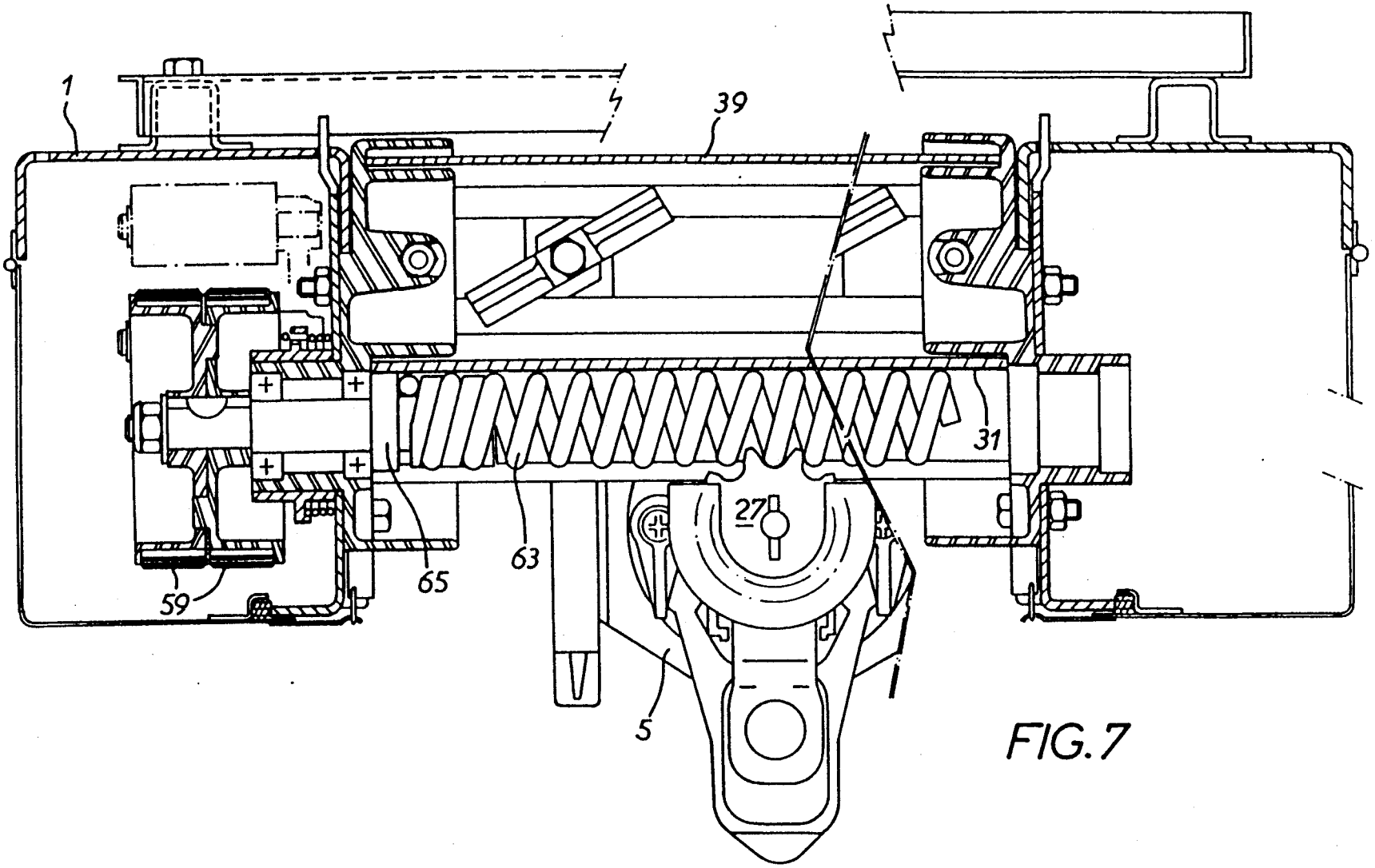
FIG. 7 is a cross-section similar to FIG. 4 showing the driving of the stirrer lids by a springscrew.

As shown in FIG. 7, the endless screws may consist of coil springs 63 constructed of steel wire of a diameter sufficient to ensure good axial rigidity. The pinions of the stirrer lids are shaped to operate with such a spring screw. It should not be forgotten moreover that the number of pinion teeth can vary, this in order to adapt to the desired stirring speed. This spring screw turns in its surrounding sleeve, which is of plastic material in order to prevent noise. The driving is performed by means of an end piece 65 mounted on the journal and fitting the shape of the spring into which it is screwed via the inside. The direction of rotation is naturally fixed so that the spring always remains tightly supported on this end piece.

It will be noted that it is possible to conceive of other forms of screw than those described and, for example, produced by rotary extrusion with cutting to length or simply by welding onto a tube a ring having the shape of the screw thread.

The above clearly demonstrates the ease with which the machine is placed in the desired configuration by virtue of this new design of the motion transmission, which makes it possible to install the racks at the desired height and spacing, by virtue of the rapid hooking of the mounting hooks onto the perforations of the uprights and, as necessary, to modify the configuration of the machine (number of racks respectively for small and for large cans), and to add additional racks. The operation is therefore simple and rapid and permits optimal use of the motive energy.

We claim:

1. Stirring machine for paints, comprising support racks (3) for cans of tints each provided with an upper stirrer lid (5), a mechanism for driving the stirrer lids on each of the racks, a stirrer shaft in each said can, the stirrer lids (5) each being provided with a motion take-up pinion (27) for operatively engaging the stirrer shaft of respectively each of the cans, said mechanism for driving the stirrer lids actuating a set of endless screws (29) mounted one on respectively each of the racks, said endless screws each meshing with the pinions (27) for driving the stirrer lids of a specific rack and being driven at a variable speed of rotation in dependence upon the range of the cans of tints of the racks.

2. Stirring machine as claimed in claim 1, wherein driving belts and pulley driven by said belts are mounted at one side of said machine for implementing the driving of the endless screws (29) of the racks (3) at the ends of said endless screws, said belts being held in position by a tension roller.

3. Stirring machine as claimed in claim 1, wherein the driving of the endless screws (29) is effectuated by driving chains and pinions connected to the end of the endless screws and being located on one side of the machine.

4. Stirring machine as claimed in any of claims 1 to 3, wherein the driving of the endless screws is effected by an electric motor (9) arranged horizontally at a lower end of the machine.

5. Stirring machine as claimed in claim 1, wherein the distribution of the motion to the screws (29) of the racks is performed by a series of serrated belts (59) with take-up of the movement from one rack to the next.

6. Stirring machine as claimed 1, wherein the speed of rotation of the stirrer lids (5) of the cans of lacquers is obtained by varying the following parameters: number of teeth of the driving pinions (27) of the stirrer lids, screw-pinions (29, 27) reduction factor and use of a primary transmission of low reduction by belt or by chain, it being possible to produce the speed reduction by the set of pulley diameters of the motor in such a manner that the suitable speed of rotation of the stirrer shafts of the lids is maintained.

7. Stirring machine as claimed in claim 1, wherein the transmission system is contained in a lateral upright (1), being protected by a casing (19) and accessible upon opening the casing.

8. Stirring machine as claimed in claim 1, wherein the endless screws (29) are implanted inside a sleeve (31) provided with a longitudinal slot (33) at the front (or slots) for placing the teeth of the pinions (27) of the lids into contact, when the latter are fitted in suspension on the transverse brackets (11) of the racks, with the thread of the screw.

9. Stirring machine as claimed in claim 1, wherein the screws (29) are constituted by short members (47) rigidly assembled to one another and being adapted in length to the desired value.

10. Stirring machine as claimed in claim 1, wherein the screws are constituted by coil spring members (63) with corresponding adaptation of the shape of the pinions (27) of the stirrer lids.

11. Stirring machine as claimed in claim 1, which comprises two lateral uprights (1), racks (3) provided with endless screws (29) for driving the pinions of the stirrer lids (5) of the cans of tints, these racks being mounted by a system with teeth (13) for hooking onto said uprights, a system (17) housed in one of the uprights, for transmission of the motion to the racks, this system, which is protected by a casing (19), being accessible upon opening of the casing, for example, in order to change the positioning of the racks, and a lower motor (9).

12. Stirring machine as claimed in claim 1, wherein the cans of tints are clipped in position on the racks.

* * * * *

UNITED STATES PATENT AND TRADEMARK OFFICE

CERTIFICATE OF CORRECTION

PATENT NO. : 5,310,258

DATED : May 10, 1994

INVENTOR(S) : Jean Godat, et al.

It is certified that error appears in the above-indentified patent and that said Letters Patent is hereby corrected as shown below:

Column 2, line 64: "f or" should read --for--

Column 4, line 23, Claim 6: "as claimed 1" should read --as claimed in claim 1--

Signed and Sealed this

Twenty-ninth Day of November, 1994

*Attest:*

Bruce Lehman

BRUCE LEHMAN

*Attesting Officer*

*Commissioner of Patents and Trademarks*